US007506652B2

(12) United States Patent
Fracassi et al.

(10) Patent No.: US 7,506,652 B2
(45) Date of Patent: Mar. 24, 2009

(54) STRUCTURALLY FLEXIBLE ARTIFICIAL NAILS

(75) Inventors: Joseph Michael Fracassi, Lake Forest, CA (US); Jeanine Catherine Coppola, Irvine, CA (US)

(73) Assignee: Pacific World Corporation, Lake Forest, CA (US)

( * ) Notice: Subject to any disclaimer, the term of this patent is extended or adjusted under 35 U.S.C. 154(b) by 131 days.

(21) Appl. No.: 10/558,594

(22) PCT Filed: Aug. 16, 2005

(86) PCT No.: PCT/US2005/029170

§ 371 (c)(1),
(2), (4) Date: Nov. 29, 2005

(87) PCT Pub. No.: WO2006/023512

PCT Pub. Date: Mar. 2, 2006

(65) Prior Publication Data

US 2007/0051384 A1 Mar. 8, 2007

Related U.S. Application Data

(60) Provisional application No. 60/601,895, filed on Aug. 16, 2004.

(51) Int. Cl.
*A45D 29/00* (2006.01)

(52) U.S. Cl. ..... 132/73

(58) Field of Classification Search ..... 132/73, 132/73.5, 285

See application file for complete search history.

(56) References Cited

U.S. PATENT DOCUMENTS 3,552,401 A * 1/1971 Michaelson et al. ..... 132/73

(Continued)

FOREIGN PATENT DOCUMENTS

EP 0167329 7/1956

(Continued)

OTHER PUBLICATIONS

Unpublished, measurements made by assignee of present application of nail thickness of various artificial nails available prior to the filing date of the priority provisional application, May 2004.

(Continued)

*Primary Examiner*—Robyn Doan
(74) *Attorney, Agent, or Firm*—Leydig, Voit & Mayer, Ltd.

(57) ABSTRACT

Provided is a preformed artificial nail designed to conform to the wearer's natural fingernail. The artificial nail includes an elongated nail body (110) that extends between a proximate edge (120) intended to abut against the cuticle and a distal edge (122) intended to extend beyond the wearer's fingertip. To allow the nail body to conform to the curve of the natural fingernail between the sides, the thickness of the nail body increases from the proximate edge to the distal edge. The relatively thinner proximate edge provides that region of the nail body with an inherent flexibility that allows the nail body to deflect and conform to the natural fingernail. The relatively thicker distal edge provides that region of the nail body with an inherent rigidity and, relatedly, additional strength to the portion of the nail body intended to extend beyond the fingertip.

18 Claims, 4 Drawing Sheets

U.S. PATENT DOCUMENTS

| | | | | | |
|---|---|---|---|---|---|
| 3,982,551 | A | * | 9/1976 | Bartolucci | 132/73 |
| 4,007,748 | A | * | 2/1977 | Matranga et al. | 132/73 |
| 4,106,614 | A | | 8/1978 | Aylott | |
| 4,346,720 | A | * | 8/1982 | Hokama | 132/73 |
| 4,625,740 | A | | 12/1986 | Roth | |
| 4,751,935 | A | | 6/1988 | Mast et al. | |
| 5,070,892 | A | | 12/1991 | Trematerra | |
| 5,209,250 | A | | 5/1993 | Taeckens | |
| 5,450,864 | A | | 9/1995 | LaJoie et al. | |
| 5,513,664 | A | | 5/1996 | Krupsky | |
| 5,676,165 | A | | 10/1997 | Bannett | |
| 5,791,482 | A | | 8/1998 | Murphy et al. | |
| 5,816,408 | A | * | 10/1998 | Indelicato | 206/581 |
| 5,944,027 | A | | 8/1999 | Chang | |
| 6,196,234 | B1 | | 3/2001 | Gifford | |
| 6,354,304 | B1 | | 3/2002 | Chang | |
| D525,747 | S | | 7/2006 | Robinson | |
| 7,100,619 | B2 | | 9/2006 | Kim | |
| 7,150,281 | B2 | | 12/2006 | Han | |
| 7,185,660 | B1 | | 3/2007 | Han | |
| 7,337,783 | B2 | | 3/2008 | Han | |
| 2004/0079381 | A1 | * | 4/2004 | Han | 132/73 |
| 2004/0173232 | A1 | | 9/2004 | Chang et al. | |
| 2005/0121048 | A1 | | 6/2005 | Han | |
| 2005/0183735 | A1 | | 8/2005 | Robinson | |
| 2006/0191551 | A1 | | 8/2006 | Han | |
| 2006/0237027 | A1 | | 10/2006 | Han | |
| 2008/0017211 | A1 | | 1/2008 | Han | |
| 2008/0017212 | A1 | | 1/2008 | Han | |
| 2008/0017213 | A1 | | 1/2008 | Han | |
| 2008/0017214 | A1 | | 1/2008 | Han | |

FOREIGN PATENT DOCUMENTS

| | | |
|---|---|---|
| EP | 1415567 | 5/2004 |
| FR | 2534120 | 4/1984 |
| GB | 725969 | 3/1955 |
| GB | 752960 | 1/1986 |
| KR | 2002008283 | 1/2002 |
| KR | 20050709081 | 8/2005 |

OTHER PUBLICATIONS

European Supplemental Search Report and Search Opinion issued in corresponding EP Appln. No. 05786762.4 (PCT/US2005/029170).

* cited by examiner

STRUCTURALLY FLEXIBLE ARTIFICIAL NAILS

FIELD OF THE INVENTION

This invention pertains generally to human fingernail decorations, and more particularly to artificial nails that are intended to be adhered to a human's natural fingernail.

BACKGROUND OF THE INVENTION

For various aesthetic reasons, many individuals wish to possess elongated fingernails or fingernails having a more finished or polished appearance. However, some are unable or unwilling to grow their own natural fingernails out to the desired length. Alternately, they may not have the time, skill, or financial wherewithal to maintain or obtain a more finished appearance that may result from well manicured and/or polished nails. As a result, entire industries have developed around the artificial supplementation and enhancement of natural nails. Such enhancements may range from manicuring and polishing of natural fingernails to individually building artificial nails on the natural nail and nail form from an acrylic powder and liquid which chemically bond to the nail surface as the artificial nail is built. Between these two extremes, are preformed, artificial nails that are glued or otherwise bonded to a person's own naturally occurring fingernails. Such nails are readily available to a wide range of users through drug and department stores. Such preformed artificial nails may be clear or opaque, and/or prepolished and/or decorated to provide the desired appearance.

Artificial nails are commonly made from molded thermoplastic and are available in a wide range of lengths and styles. One broad category of an artificial nail style is the full nail form. As its name implies, the full nail form simulates the entire human fingernail and includes a proximate edge intended to overlay substantially the entire nail bed and a distal free edge which is intended to extend beyond the fingertip of the wearer. The proximate edge is shaped to be disposed substantially adjacent or abut against the cuticle of the finger. The distal free edge may have any of various lengths and shapes, such as oval, square, or flared, depending upon the desired look. Additionally, to further simulate a natural fingernail, the artificial nail is typically formed with a curvature between a first side edge and a second side and a curvature between the proximate and distal edges. Preferably, the artificial nail is sufficiently durable and rigid to withstand the hazards inherent in its use.

Manufacturers typically provide users with a range of nail sizes, e.g., identified by size numbers 0-9, to accommodate most nail sizes. Generally, artificial nails are packaged together in sets including a range of different sizes so that the purchaser receives differently artificial nails for their different fingers. In addition to the set of different sized artificial nails, the package may also include liquid adhesive and/or peel-off adhesive pads for bonding the artificial nails to the purchaser's natural fingernails.

It is well known, however, that the contour of natural fingernails varies greatly between individuals and even between different fingers on the same individual. It has been difficult, if not impossible, to produce artificial nails having degrees of curvature between the first and second side edges and proximate and distal edges that accommodate all natural fingernails. While manufacturers may produce a large number of artificial nails with a variety of curves, this solution is undesirable and impractical because of the associated increase in manufacturing costs. As a result, manufactures typically produce a set of preformed artificial nails have varying widths and including set degrees of curvature.

Variations between the curvatures of the preformed artificial nail and the natural nail, however, may affect the integrity of the attachment to the nail, the comfort to the wearer, and the aesthetic appeal of the nail when secured to the natural nail. For example, some individuals have one or more relatively flat nail beds. When attaching an artificial nail that is more curved than the natural nail bed, there will be a gap between the artificial and natural nail bed. In order to adequately bond the artificial nail to the nail bed, a proportionally greater amount of adhesive must be applied. The best bond, however, is obtained from a thin layer of glue between adjacently disposed artificial and natural nail surfaces. A greater amount of glue may result in the formation of air pockets within the volume of glue, weakening the bond. Consequently, the use of a greater amount of glue may actually result in a less durable bond between the artificial and natural nails, and shorten wear time. Moreover, when the user presses the more arched artificial nail downward against the flatter natural nail bed of the user, and the bond is established, the artificial nail will seek to return to its natural, more arched free position. As a result, this pulling on the natural nail bed can cause the user significant pain and discomfort.

BRIEF SUMMARY OF THE INVENTION

The invention provides a preformed artificial nail that is designed to allow the artificial nail to flex and conform to the curved shape of a nail bed of a natural fingernail along the nail bed portion, while maintaining the strength and durability of conventional nails. The artificial nail has a nail body that includes a proximate edge intended to abut against or be disposed substantially adjacent the user's cuticle and a spaced-apart distal edge intended to extend beyond the tip of the wearer's natural fingernail. Extending between the proximate and distal edges are a first side edge and a generally parallel second side edge. To simulate a natural fingernail, the artificial nail is formed with a curve or arc extending between the first and second side edges, and, typically between the proximate and distal edges.

To enable the artificial nail to conform to the nail bed of the wearer, the thickness of the artificial nail body continuously increases between the proximate edge and the distal edge. Accordingly, the portion of the nail body corresponding to the proximate edge is sufficiently thin to demonstrate a degree of flexibility while the portion corresponding to the distal end is sufficiently thick to provide strength to the artificial nail. In this way, the flexibility of the artificial nail increases as along the length of the nail from a relatively rigid distal end portion to a relatively flexible proximate portion. Thus, the flexibility associated with the portion of the artificial nail corresponding to the proximate edge allows that portion of the artificial nail to be pressed adjacent to the nail bed. More specifically, the flexible portion of the artificial nail can deform to mirror the curve of the nail bed between the first and second sides of the wear's own natural fingernail. As a result, the inventive nail will result in a reduction, and, sometimes, elimination of the pain often caused to the user by the arched nail seeking to return to its free state and exerting and upward force on a flatter natural nail bed or the edges of a more curved natural nail bed.

Among other things, the invention minimizes the chances of formation of air pockets within the layer of glue between the artificial and natural nails. Thus, an advantage of the invention is that it provides a stronger bond between the artificial nail and the natural fingernail, and a reduction in user discomfort. Another advantage is that the invention provides a more natural appearing transition between the artificial nail and the nail bed, and is therefore more aesthetically pleasing. These and other advantages of the invention, as well as additional inventive features, will be apparent from the description of the invention provided herein.

DETAILED DESCRIPTION OF THE INVENTION

Figure 1:
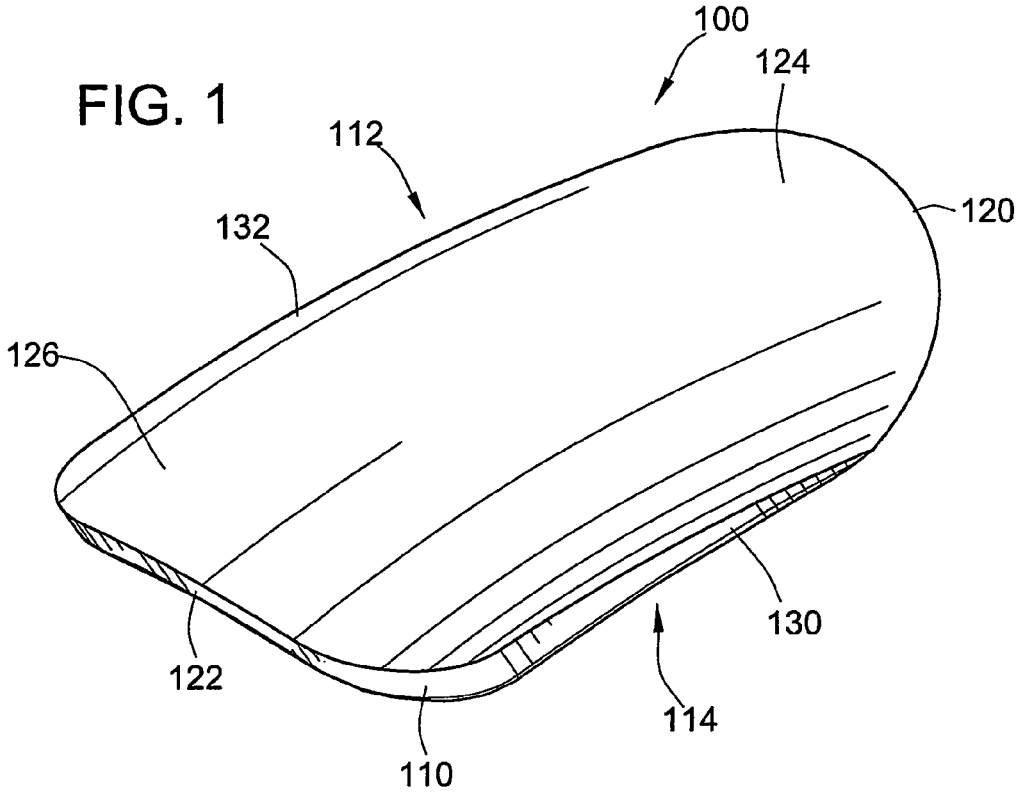
FIG. 1 is a top perspective view of an artificial nail constructed in accordance with teachings of the invention.

Now referring to the drawings, wherein like reference numbers refer to like elements, there is illustrated in FIG. 1 an artificial nail 100 designed in accordance with the teachings of the invention. The artificial nail 100 includes a nail body 110 having an upper surface 112 and a lower surface 114. As will be appreciated, the lower surface 114 is intended to overlay the natural fingernail of the wearer. To adhere or bond the artificial nail to the natural fingernail, a liquid adhesive or an adhesive pad is typically placed between the lower surface 114 and the nail bed of the natural fingernail while the nail body and natural fingernail are pressed together. For the purposes of this application, the term bonded will include both temporary or more permanent adhesion. Preferably, the adhesive or adhesive pad is degradable along at least the interface with the natural nail to permit easy removal of the artificial nail with an appropriate, safe solution.

The nail body 110 has an elongated shape and extends between a proximate edge 120 and a spaced-apart distal end 122. The proximate edge 120 demarcates a corresponding proximate region 124 of the nail body 110 while the distal end 120 likewise demarcates a corresponding distal region 126. When the artificial nail 100 is adhered or bonded to the natural nail of a wearer as intended, the proximate region 124 is disposed adjacent the natural nail bed while the distal region 126 typically extends beyond the free edge of the wearer's finger nail. Extending between the proximate edge 120 and the distal edge 122 are a first side edge 130 and a generally opposing second side edge 132.

Figure 3:
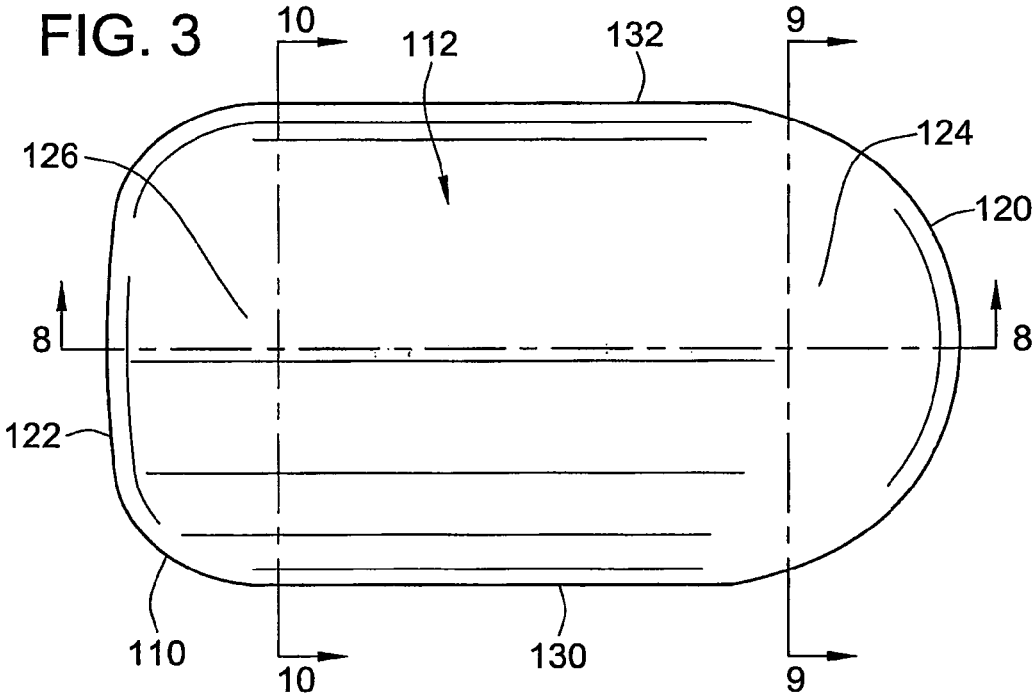
FIG. 3 is a top plan view of the artificial nail of FIG. 1.
Figure 4:
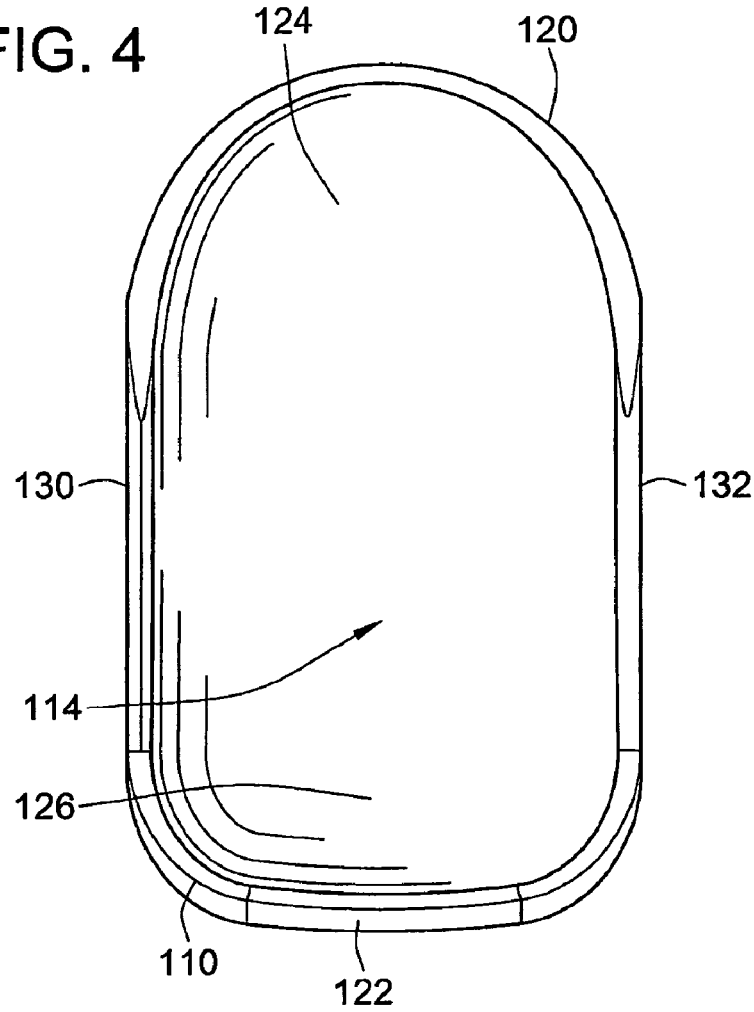
FIG. 4 is a bottom plan view of the artificial nail of FIG. 1.
Figure 6:
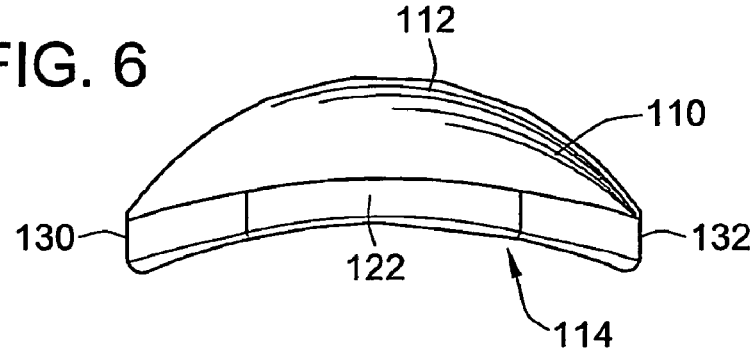
FIG. 6 is an elevational view taken from a distal edge of the artificial nail of FIG. 1.

Referring to FIGS. 3 and 4, to enable the proximate edge 120 to abut against and generally trace the cuticle, the proximate edge 120 is typically shaped as a rounded curve extending between the first and second side edge 130, 132. In the embodiment illustrated in FIGS. 3 and 4, the distal edge 122, in contrast to the proximate edge 120, is generally squared-off. However, the shape of the distal edge 122 is a function of fashion and the squared-off appearance is only one example of the possible shapes that the distal edge can have. For example, the shape could alternately be expanded and/or flattened at or along the free edge. The length of the nail body 110 is defined between the proximate and distal edges 120, 122 while the width of the nail body is defined between the first and second side edges 130, 132.

Various sizes of nails are commonly accorded numerical designations as a manner of distinguishing the sizes. By way of example only, and by no means as a limitation, the sizes corresponding to the numerical designations may be as follows:

| Nail Number | Length | Width |
|---|---|---|
| 0 | 22.5 mm | 16 mm |
| 1 | 22 mm | 15.6 mm |
| 1.5 | 21.4 mm | 14.6 mm |
| 2 | 21 mm | 13.8 mm |
| 2.5 | 20 mm | 12.6 mm |
| 3 | 19.5 mm | 11.9 mm |
| 3.5 | 18.5 mm | 10.9 mm |
| 4 | 17.4 mm | 10.5 mm |
| 4.5 | 17.1 mm | 10.5 mm |
| 5 | 16.9 mm | 9.8 mm |
| 5.5 | 16.5 mm | 9.9 mm |
| 6 | 16 mm | 9.6 mm |
| 6.5 | 14.9 mm | 9.1 mm |
| 7 | 15 mm | 8.7 mm |
| 7.5 | 14.4 mm | 8.5 mm |
| 8 | 13.4 mm | 7.9 mm |
| 8.5 | 13 mm | 7.6 mm |
| 9 | 11.9 mm | 6.7 mm |

Figure 7:
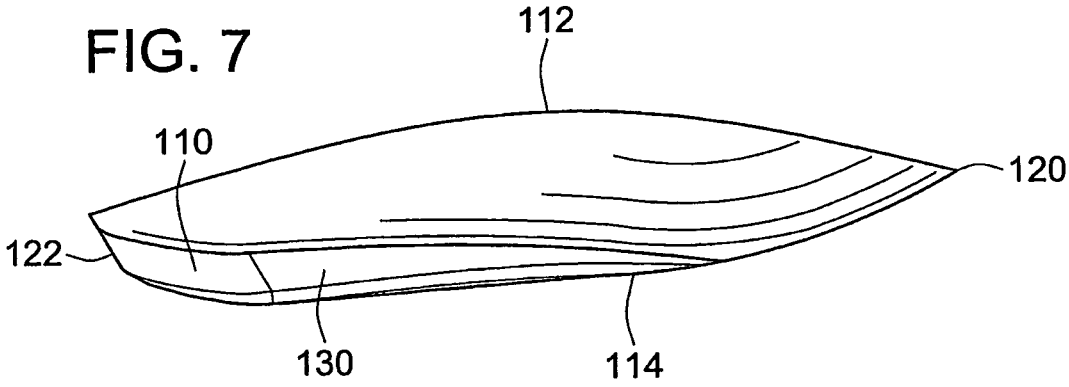
FIG. 7 is a side elevational view taken along a first side view of the artificial nail of FIG. 1.

Referring to FIGS. 3 and 4, so that the artificial nail 100 appears natural and appropriately sits upon the wearer's finger, the nail body 110 is formed with a curved or an arched shape between the first and second side edges 130, 132. Specifically, the upper surface 112 is generally convex while the lower surface 114 is generally concave. When placed against a horizontal surface, the apex of the nail body 110 will lie above the first and second side edges 130, 132. Referring to FIG. 7, to simulate the curved or camber profile that an elongated natural fingernail has, the nail body 110 generally curves over its length between the proximate edge 120 and the distal edge. It will be appreciated, however, that alternate shapes may be provided, such as, for example, relatively short "sport" nails, or nails having an expanded shape such as those disclosed in U.S. application Ser. No. 29/197354, which is assigned to the assignee of the present application.

Figure 8:
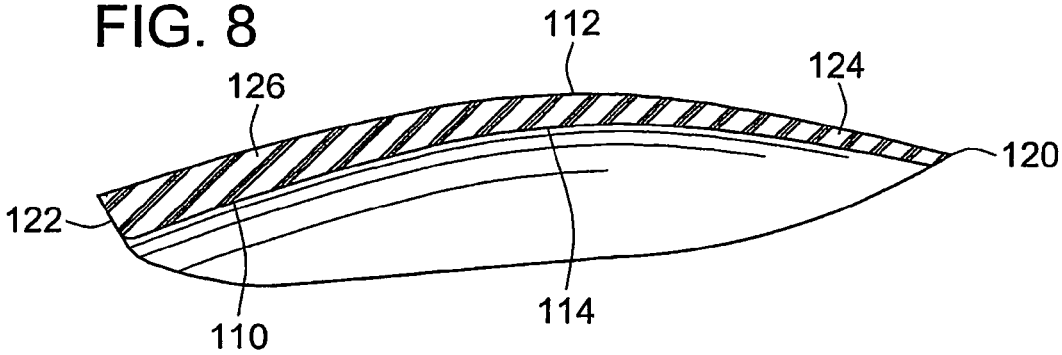
FIG. 8 is a cross-sectional view through a centerline extending between first and second side edges of the artificial nail taken along line 8-8 of FIG. 3.
Figure 9:
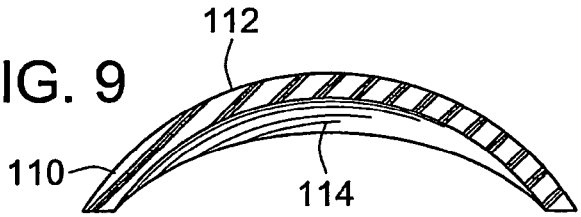
FIG. 9 is a cross-sectional view through the proximate region of the artificial nail taken along line 9-9 of FIG. 3.
Figure 10:
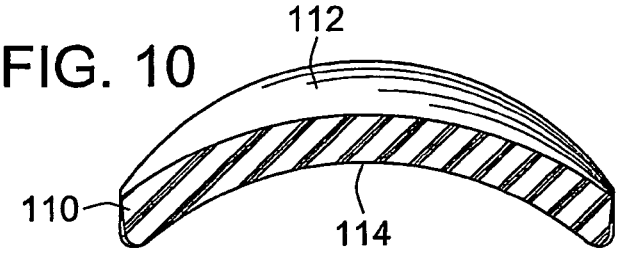
FIG. 10 is a cross-sectional view through the distal region of the artificial nail taken along line 10-10 of FIG. 3.
Figure 5:
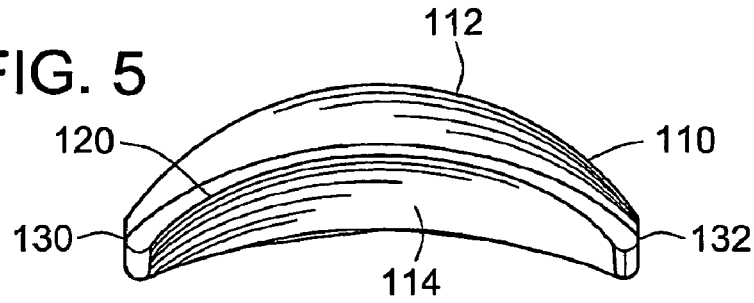
FIG. 5 is an elevational view taken from a proximate edge of the artificial nail of FIG. 1.

In accordance with the invention, in order to provide a more universal fit to user's natural nails, the proximate region 124 of the nail 100 is provided with a degree of flexibility such that the preformed artificial nail may be flattened or provided with a greater arch to cause the artificial nail 100 to conform more closely to a user's natural finger nail. Referring to FIG. 8, to provide the artificial nail with varying degrees of flexibility, the thickness of the nail body 110 defined between the first and second surfaces 112, 114 increases over the length of the nail body from the proximate edge 120 to the distal edge 122. Accordingly, as compared in FIGS. 9 and 10, the thickness of the nail body 110 measured within the proximate region 124 is substantially less than the thickness measured within the distal region 126. As will be appreciated, if the nail body 110 is made from a material wherein the degree of flexibility depends, at least in part, upon the corresponding degree of thickness, the thinner proximate region 124 demonstrates a substantially greater degree of flexibility compared to the thicker distal region 126 which demonstrates a relative degree of rigidity.

In as much as the proximate region 124 is more flexible than the distal region 126, the proximate region 124 may be "flattened" to conform to the natural shape of a flatter natural nail bed, or the first and second side edges 130, 132 drawn more toward each other to more closely conform to a natural nail with a greater arch from side to side. Specifically, even if the degree of curvature formed into the nail body 110 during molding is greater or less than the degree of curvature of a natural fingernail, the artificial nail may still be utilized in that it may be conformed to the natural nail bed in placement. When pressed against the nail bed of a flatter natural fingernail, the portions of the first and second side edges 130, 132 extending from the proximate edge 120 contact the nail bed first and are deflected apart until the lower surface 114 of the nail body 110 corresponding to the proximate region 124 lies adjacent the natural fingernail. Conversely, when pressed against the nail bed of a more arched natural fingernail, the portions of the first and second side edges 130, 132 extending from the proximate edge 120 may be manually arched downward to contact the nail bed until the proximate portion of lower surface 114 of the nail body 110 conforms to the proximate region 124 of the natural fingernail.

By conforming the proximate region 124 to adjacently contact the nail bed, a stronger bond between the artificial nail 100 and natural fingernail is produced. Specifically, where liquid adhesive or adhesive pads are used to bond the artificial nail 100 to the natural fingernail, the adhesive bond between the lower surface 114 and the natural fingernail will have a more uniform profile along the curvature of the natural fingernail. Additionally, because of the added flexibility of the proximate region 124, the nail body 110 will have less of a tendency to separate itself from the natural fingernail due to the resilient forces of the nail body material. This is especially advantageous during application when the artificial nail 110 has been pressed adjacent to the natural fingernail, but the applied adhesive or adhesive pad has yet to completely cure. Furthermore, conforming the shape of the proximate region 124 to the nail bed provides a more natural appearing and aesthetically pleasing joinder between the two.

In as much as the distal region 126 is more rigid than the flexible proximate region 124, that the portion of the artificial nail 100 intended to extend beyond the natural finger nail free edge is provided with added strength. Hence, the artificial nail is more resistant to deformation due to impact with external objects. Accordingly, the artificial nail 100 is more durable and can last longer once applied than an artificial nail of a substantially continuous reduced thickness.

Preferably, the thickness of the nail body 110 increases continuously between the proximate edge 120 and the distal edge 122. Accordingly, the transition between regions of flexibility and rigidity occurs gradually with the most flexibility occurring at the proximate edge 120 and the most rigidity occurring at the distal edge 122. The gradual transition between regions of flexibility and rigidity enables the nail body 110 to accommodate nail beds of various shapes, lengths, and sizes thereby making the artificial nail 100 more versatile. If, for example, the proximate portion of an artificial nail was provided with a constant thickness, and the distal portion with a greater, alternate constant thickness, and a step provided between to the two, the step would necessarily be placed at or beyond the distal edge of the user's natural nail. As a result, a given preformed artificial nail would necessarily only properly fit a very limited range of nail lengths. In contrast, the preformed artificial nail 100 having a gradual transition from the proximate to distal ends may be successfully utilized on substantially any length of nail.

Figure 2:
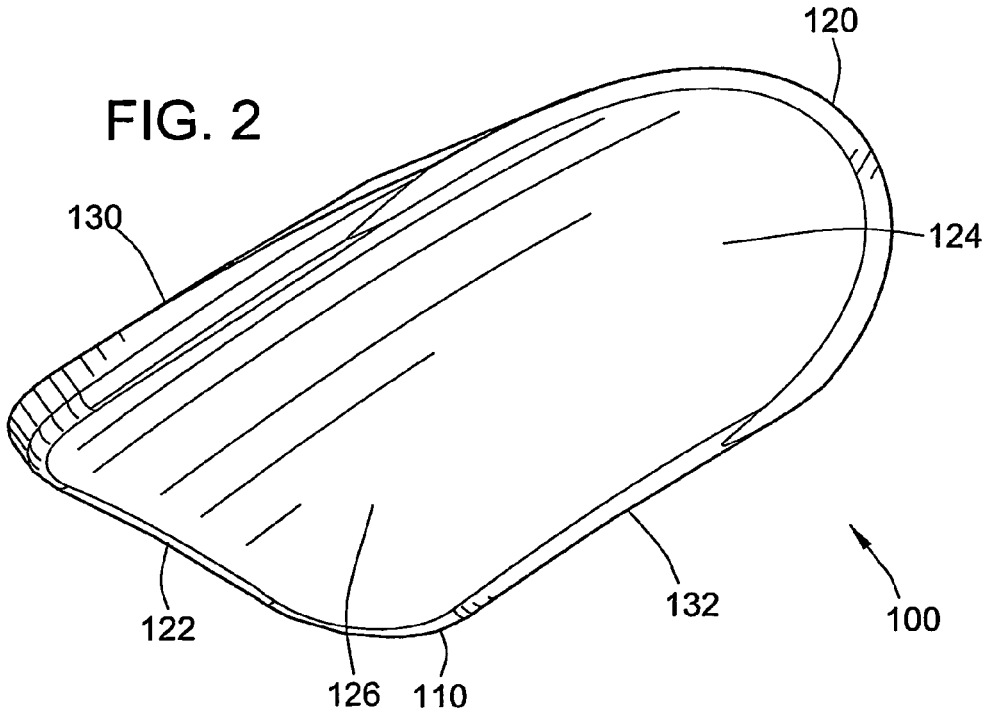
FIG. 2 is a bottom perspective view of the artificial nail of FIG. 1.

Another advantage of increasing the thickness of the nail body 110 from the proximate edge 120 to the distal edge 122 is realized in the manufacturing of the artificial nail. Referring to FIGS. 1 and 2, it will be appreciated by those of skill in the art that the mold for the nail body 110 can be designed such that the gates for introducing molten thermoplastic access the mold cavity proximate a side that corresponds to the distal edge 122. With injection molding or similar molding methods, the molten thermoplastic flows within the mold cavity between two converging surfaces that correspond to the upper and lower surfaces 112, 114 toward a side that corresponds to the proximate edge, whereat a vent for displaced air can be loaded. While molding the nail body 110 in this manner reduces the chance that voids will be formed within the nail body, it will be appreciated that any other appropriate methods may be utilized to fabricate the nail body 110, however.

The desired combinations of flexibility and rigidity preferably can be achieved by increasing the thickness of the nail body 110 between the proximate edge 120 and the distal edge 122 by at least 0.020 of an inch (0.51 mm), and more preferably at least 0.022 of an inch (0.55 mm). By way of a preferred example, the nail body 110 can have a proximate edge 120 with a thickness of 0.009 inches (0.23 mm) and a distal end 122 of 0.035 inches (0.89 mm). Therefore, in this example, the total change in thickness of the length of the nail body is 0.026 inches (0.66 mm). Expressed in another way, the thickness of the nail body decreases from the distal edge 122 to the proximate edge 120 by at least about 70% and more preferably by about 75%.

Figure 11:
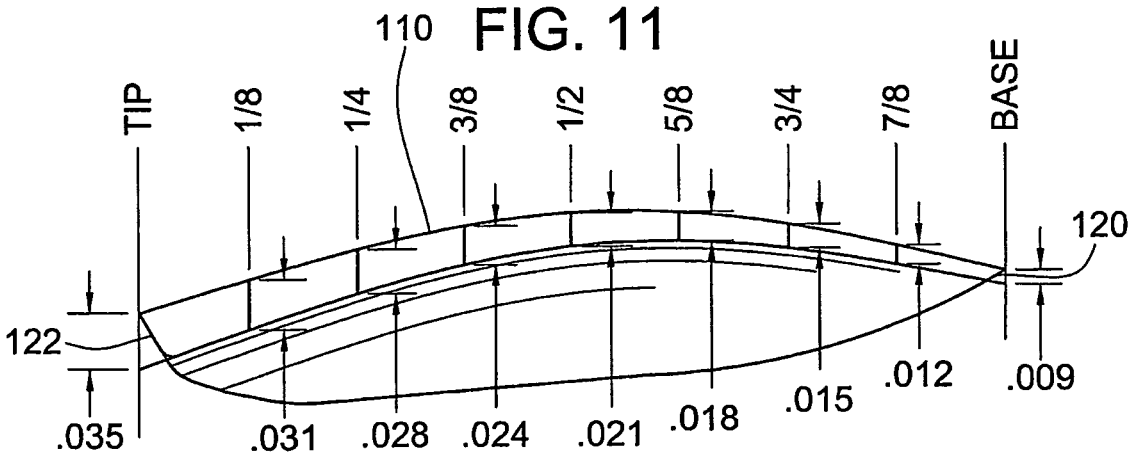
FIG. 11 is a cross-sectional view similar to FIG. 8 of an exemplary artificial nail of varying thickness.

An example of a nail body 110 having a preferred change in thickness is illustrated in FIG. 11. In the illustrated example, the change in thickness occurs substantially continuously and substantially consistently over the length of the nail body 110. For example, the thickness measured at the proximate edge 120 of the nail body is about 0.009 inches (0.23 mm), the thickness measured at ⅛ of the overall length of the nail body from the proximate edge is about 0.012 inches (0.30 mm), the thickness measured at ¼ of the overall length is about 0.015 inches (0.38 mm), the thickness measured at ⅜ of the overall length is about 0.018 inches (0.46 mm), the thickness measured at ½ of the overall length is about 0.021 inches (0.53 mm), the thickness measured at ⅝ of the overall length is about 0.024 inches (0.61 mm), the thickness measure at ¾ of the overall length is about 0.027 inches (0.69 mm), the thickness measured at ⅞ of the overall length is about 0.031 inches (0.78 mm), and the thickness measured at distal edge 122 is about 0.035 inches (0.89 mm). Accordingly, the thickness of the nail body 110 increases between approximately 0.003-0.004 inches (0.07-0.09 mm) over every ⅛ of the length of the nail body. It will be appreciated by those of skill in the art, however, that alternate thicknesses are likewise within the purview of the invention. By way of example only, for these same locations, i.e., proximate edge, ⅛ inch, ¼ inch, ⅜ inch, ½ inch, ⅝ inch, ¾ inch, and ⅞ inch, alternate measures may be provided, such as 0.009 inches (0.23 mm), 0.012 inches (0.30 mm), 0.013 or 0.0135 inches (0.33 or 0.34 mm), 0.015 inches (0.38 mm), 0.016 or 0.018 inches (0.41-0.46 mm), 0.0195 or 0.021 inches (0.50-0.53 mm), 0.022 or 0.023 inches (0.55-0.58 mm), 0.025 or 0.026 inches (0.63-0.0.66 mm), and 0.0312 inches (0.80 mm), respectively.

The preferred change in thickness of at least 0.022 inches (0.55 mm), and more preferably about 0.026 inches (0.66 mm), can be the same for a variety of nail body lengths. It will be appreciated that the smaller artificial nails will have a correspondingly smaller flexible proximate region and a smaller rigid distal region. However, to achieve the same transition between relative degrees of flexibility and rigidity across the length for the various nail body sizes, the thickness of each nail body should still preferably change at least 0.022 inches (0.55 mm), and preferably about 0.026 inches (0.66 mm). Hence, when packaged for distribution, artificial nail bodies of differing length intend to be applied to different fingers should preferably each all increase in thickness at least about 0.022 inches (0.55 mm), and preferably about 0.026 inches (0.66 mm), between the proximate edge and the distal edge.

The nail body 110 can be made from any suitable material and preferably is made from thermoplastic. By way of example only, suitable thermoplastic materials include acrylonitrile butadiene styrene (ABS), polyethylene (PE), polyvinyl chloride (PVC), polystyrene and polyethylene-terephthalate (PET) and combinations thereof, by coextrusion or otherwise. Furthermore, the composition of material in the nail body can be consistently uniform throughout or can be comprise generally discrete regions of differing materials or combinations of materials.

In various embodiments, the artificial nails can be opaque, translucent, or transparent. Additionally, the artificial nails can be provided in various colors and glosses that simulate painted fingernails and may include nail tattoos or charms. Moreover, the artificial nails can be painted or formed in different colors and patterns to simulate decorations such as strips or flowers. In further embodiments, the artificial nails can be formed with raised protuberances that are shaped to simulate, for example, decorative flowers.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A preformed artificial nail adapted to substantially cover an upper surface of a user's natural nail, the upper surface of the natural nail extending from a cuticle and having an oppositely disposed free edge, the artificial nail comprising:

an elongated nail body extending between a proximate edge and a distal edge, and a left side and a right side, and having a thickness, the proximate edge being adapted to be disposed substantially adjacent the user's cuticle, a longitudinal direction being defined from the proximate edge to the distal edge and a lateral direction being defined from the left side to the right side, wherein the thickness of the nail body substantially continuously increases from the proximate edge to the distal edge, the thickness decreasing from the distal edge to the proximate edge by at least one of either at least 0.020 inches (0.51 mm) or at least about 70% as measured by the difference between the thickness of the nail at the distal and proximate ends divided by the thickness at the distal end multiplied by 100, and thickness is substantially uniform in a lateral direction from the left side to the right side across the nail body, the nail body being unitarily formed of a single material.

2. The preformed artificial nail of claim 1, wherein the thickness increases by at least 0.022 inches (0.55 mm) from the proximate edge to the distal edge.

3. The preformed artificial nail of claim 1, wherein the thickness of the nail body changes between the proximate edge and the distal edge at a substantially constant rate.

4. The preformed artificial nail of claim 3, wherein the thickness of the nail body changes about 0.001-0.006 inches (0.025-0.16 mm) per approximately every ⅛ of the overall length of the nail body.

5. The preformed artificial nail of claim 3, wherein the thickness of the nail body changes about 0.003-0.004 inches (0.07-0.09 mm) per approximately every ⅛ of the overall length of the nail body.

6. The preformed artificial nail of claim 1, wherein the thickness decreases at least about 75%.

7. The preformed artificial nail of claim 1, wherein the nail body is comprised of molded thermoplastic.

8. The preformed artificial nail of claim 7, wherein the thermoplastic is selected from the group consisting of acrylonitrile butadiene styrene (ABS), polyethylene (PE), polyvinyl chloride (PVC), polystyrene and polyethylene-terephthalate, and combinations of any of these.

9. A package of preformed artificial nails adapted to substantially cover an upper surface of a user's natural nails, the upper surface of the natural nail extending from a cuticle and having an oppositely disposed free edge, the package comprising:

a plurality of artificial nails each having an elongated nail body extending between a proximate edge and a distal edge, and a left side and a right side, and having a thickness, the proximate edge being adapted to be disposed substantially adjacent the user's cuticle, a longitudinal direction being defined from the proximate edge to the distal edge and a lateral direction being defined from the left side to the right side, wherein for at least a majority of the artificial nails, the thickness of each nail body of said majority continuously decreases from the distal edge to the proximate edge by at least one of either at least 0.022 inches (0.55 mm) or at least substantially 70% as measured by the difference between the thickness of the nail at the distal and proximate ends divided by the thickness at the distal end multiplied by 100, and the thickness is substantially uniform in a lateral direction from the left side to the right side across the nail body, the nail body being unitarily formed of a single material.

10. The package of claim 9 further comprising adhesive for securing the nails to natural nails.

11. The package of claim 9, wherein the thickness increases at least 0.020 inches (0.51 mm) between the proximate edge and the distal edge.

12. The package of claim 10, wherein the adhesive is selected from the group consisting of liquid adhesive and adhesive pads.

13. The package of claim 9, wherein the thickness increases by at least 0.022 inches (0.55 mm) from the proximate edge to the distal edge.

14. The package of claim 9, wherein the thickness changes between the proximate edge and the distal edge at a substantially constant rate.

15. The package of claim 9, wherein the thickness changes about 0.001-0.006 inches (0.025-0.16 mm) per approximately every ⅛ of the overall length of the nail body.

16. The package of claim 15, wherein the thickness changes about 0.003-0.004 inches (0.07-0.09 mm) per approximately every ⅛ of the overall length of the nail body.

17. The package of claim 9, wherein the thickness decreases at least about 75%.

18. The package of claim 9, wherein the nail bodies are comprised of molded thermoplastic.

* * * * *